US010781563B2

(12) United States Patent
MacNeil et al.

(10) Patent No.: US 10,781,563 B2
(45) Date of Patent: Sep. 22, 2020

(54) HYDRODEMOLITION SYSTEM

(71) Applicant: Mac & Mac Hydrodemolition Inc., Surrey (CA)

(72) Inventors: Gerard J. MacNeil, Surrey (CA); Jesse MacNeil, Surrey (CA); Brett MacNeil, Surrey (CA); Gordon MacNeil, Surrey (CA); Vernon Bose, Surrey (CA)

(73) Assignee: Mac & Mac Hydrodemolition Inc., Surrey (CA)

( * ) Notice: Subject to any disclaimer, the term of this patent is extended or adjusted under 35 U.S.C. 154(b) by 0 days.

(21) Appl. No.: 16/153,332

(22) Filed: Oct. 5, 2018

(65) Prior Publication Data

US 2019/0106894 A1 Apr. 11, 2019

(30) Foreign Application Priority Data

Oct. 5, 2017 (CA) ..... 2981526

(51) Int. Cl.
*E01C 23/12* (2006.01)
*E04G 23/08* (2006.01)

(52) U.S. Cl.
CPC ..... *E01C 23/128* (2013.01); *E04G 23/081* (2013.01)

(58) Field of Classification Search
CPC ..... E01C 23/128; E04G 23/081
USPC ..... 280/6.155, 6.156, 6.15, 6.153, 6.154, 280/6.157, 6.159, 6.16; 299/39.6
See application file for complete search history.

(56) References Cited

U.S. PATENT DOCUMENTS 3,414,327 A * 12/1968 Austin ..... E01C 19/008 299/1.5
4,572,580 A * 2/1986 Bieri ..... E01C 23/0933 299/1.5
5,022,927 A * 6/1991 Seidel ..... B08B 3/024 134/16
5,240,503 A * 8/1993 Levy ..... A47L 1/02 118/323
5,810,448 A * 9/1998 Kingsley ..... B23D 47/12 299/39.3
6,243,625 B1 6/2001 Wyatt et al.
7,556,319 B1 * 7/2009 Boos ..... E04G 23/02 299/17
7,748,789 B2 * 7/2010 Freeburn ..... E01C 23/088 299/39.5
2003/0178884 A1 * 9/2003 Fischer ..... B60G 3/01 299/39.6
2004/0099293 A1 * 5/2004 MacNeil ..... B08B 9/0433 134/167 C
2015/0368920 A1 12/2015 MacNeil et al.

FOREIGN PATENT DOCUMENTS

WO WO 2000/43635 A1 * 7/2000

* cited by examiner

*Primary Examiner* — David J Bagnell
*Assistant Examiner* — Michael A Goodwin
(74) *Attorney, Agent, or Firm* — Pequignot + Myers; Matthews A. Pequignot; Evan J. Newman

(57) ABSTRACT

A hydrodemolition rig for an inclined surface comprises a frame, a carriage, and a plurality of wheel assemblies. The wheel assemblies are spaced from one another about the frame, with at least two of the wheel assemblies comprising a wheel and a hydraulic assembly for selectively adjusting the spacing between the wheel and the frame. The carriage is configured to reciprocate within the frame and to carry one or more nozzles for delivering water for hydrodemolition.

18 Claims, 8 Drawing Sheets

HYDRODEMOLITION SYSTEM

FIELD OF THE INVENTION

This invention relates to hydrodemolition. In particular, this invention relates to a method and apparatus for the hydrodemolition of inclined surfaces, such as the walls of dams and spillways.

BACKGROUND OF THE INVENTION

It is known to use hydrodemolition to scarify surfaces, such as the walls of dams and spillways. One such approach is disclosed in U.S. patent application Ser. No. 14/746,348 to MacNeil et al., commonly owned with the present application. MacNeil et al. describes a method of hydrodemolishing the surface of an inclined wall that employs a rig suspended by cables from a staging platform that also leans on and rides on the wall that is to be worked. The rig comprises various machinery, including movable hydrodemolition nozzles to hydrodemolish a portion of the wall within a footprint of the rig. Once that portion has been hydrodemolished, the rig may be moved to another position on the wall so that another portion of the wall may be hydrodemolished.

Upward and downward movement of the rig along the wall may be achieved through rollers located generally at the corners of the rig. The rig may be mounted on rails, or alternatively it is possible to provide wheels to roll directly over the surface of the wall.

One issue that may arise depending on the degree of inclination of the wall is that the rig becomes inclined with the wall. If the rig is top-heavy, there is a risk that the rig may topple over if the incline is too severe.

Where the rig rolls directly over the surface of the wall, the rig may also become uneven when it straddles a portion of the wall whose surface has already been hydrodemolished. As a result, the orientation of the nozzles to the surface may no longer be optimized and will be inconsistent as compared to a pass of the rig where no straddling was involved.

It is therefore an object of the present invention to provide an effective way of accommodating the incline of the wall during hydrodemolition and of providing stability for the rig. Those and other objects will be better understood by reference to the detailed description of the preferred embodiment which follows. Not all of the objects are necessarily met by all embodiments of the invention described below or by the invention defined by each of the claims.

SUMMARY OF THE INVENTION

According to a particular embodiment of the present invention, the rig comprises wheels or rollers that may be selectively extended. As a result, the overall inclination of the rig may be adjusted with respect to the underlying surface, or the inclination may be adjusted to compensate for one side of the rig riding on a portion of the wall that has already been hydrodemolished to a certain depth.

According to one embodiment of the invention, a hydrodemolition rig for an inclined surface comprises a frame, a carriage, and a plurality of wheel assemblies spaced from one another about the frame. The carriage is configured to reciprocate within the frame and to carry one or more nozzles for delivering water to hydrodemolish the surface underlying the frame. The plurality of wheel assemblies supports the frame on the surface, with at least two of the wheel assemblies comprising a wheel and a hydraulic assembly for selectively adjusting the spacing between the wheel and the frame.

In a further embodiment, the wheel assemblies are located on a periphery of the frame.

In yet a further embodiment, the frame comprises a lower frame, an upper frame, and a track assembly between the lower frame and the upper frame.

In still yet a further embodiment, the lower frame comprises two spaced side members, wherein each of the hydraulic assemblies is connected to one of the side members.

In another embodiment, the track assembly comprises at least two tracks connected to the lower frame and extending a width of the frame.

In yet another embodiment, the carriage is adapted to move along the tracks.

In still yet another embodiment, the upper frame comprises a plurality of legs extending from one of the lower frame or the track assembly and an upper platform supported by the legs.

In another embodiment, the upper frame comprises a plurality of upper roller and the track assembly comprises a plurality of lower rollers.

In yet another embodiment, the hydrodemolition rig further comprises a belt extending around the upper rollers and the lower rollers.

In still yet another embodiment, the belt is connected to the carriage.

In a further embodiment, each of the hydraulic assemblies comprises an axle, an arm, and a hydraulic cylinder. The axle is attached to the respective wheel of the respective wheel assembly. The arm comprises first and second arm ends, wherein the arm is rotationally connected to the axle proximate to the first arm end and wherein the arm is pivotably connected to the lower frame proximate to the second arm end. The hydraulic cylinder comprises first and second cylinder ends, wherein the hydraulic cylinder is pivotably connected to the arm proximate to the first cylinder end and wherein the hydraulic cylinder is pivotably connected to the lower frame proximate to the second cylinder end.

In yet a further embodiment, the lower frame comprises one or more brackets extending from the side members. The hydraulic cylinder is pivotably connected to the lower frame proximate to the second cylinder end at one of the brackets.

In still yet a further embodiment, the hydraulic cylinder is adapted to extend or contract, thereby adjusting the height of the frame proximate to the location with respect to the respective wheel.

In still a further embodiment, the hydrodemolition rig comprises one or more ballast tanks attached to the frame.

In another embodiment, a hydrodemolition rig for an inclined surface comprises one or more nozzle assemblies for delivering water for hydrodemolishing the surface and a plurality of wheel assemblies. The wheel assemblies are at various locations on a periphery of the hydrodemolition rig, and each of the wheel assemblies comprises a wheel for travel along the surface and a hydraulic assembly connected to the wheel. The hydraulic assembly is adapted to adjust a height of the hydrodemolition rig proximate to the respective location with respect to the wheel. The hydraulic assemblies are configured to increase or decrease the height proximate to their respective locations.

In still another embodiment, the one or more nozzle assemblies comprise one or more nozzles.

In yet another embodiment, a method of hydrodemolishing a surface of a wall comprises the steps of providing a hydrodemolition rig comprising a frame and a plurality of wheel assemblies, each of the wheel assemblies comprising a wheel and a hydraulic assembly connected to the wheel and to a location on the frame, the hydraulic assembly adapted to adjust a height of the frame proximate to the location with respect to the wheel; adjusting a tilt of the frame by adjusting the heights at the respective locations through the respective hydraulic assemblies; and delivering water from one or more nozzle assemblies on the hydrodemolition rig to the surface for hydrodemolition.

In still yet another embodiment, the step of adjusting, for each of the one or more of the hydraulic assemblies, the heights at those respective locations comprises extending or contracting a hydraulic cylinder connected to the wheel and to the frame.

The foregoing may cover only some of the aspects of the invention. Other and sometimes more particular aspects of the invention will be appreciated by reference to the following description of at least one preferred mode for carrying out the invention in terms of one or more examples. The following mode(s) for carrying out the invention are not a definition of the invention itself, but are only example(s) that embody the inventive features of the invention.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
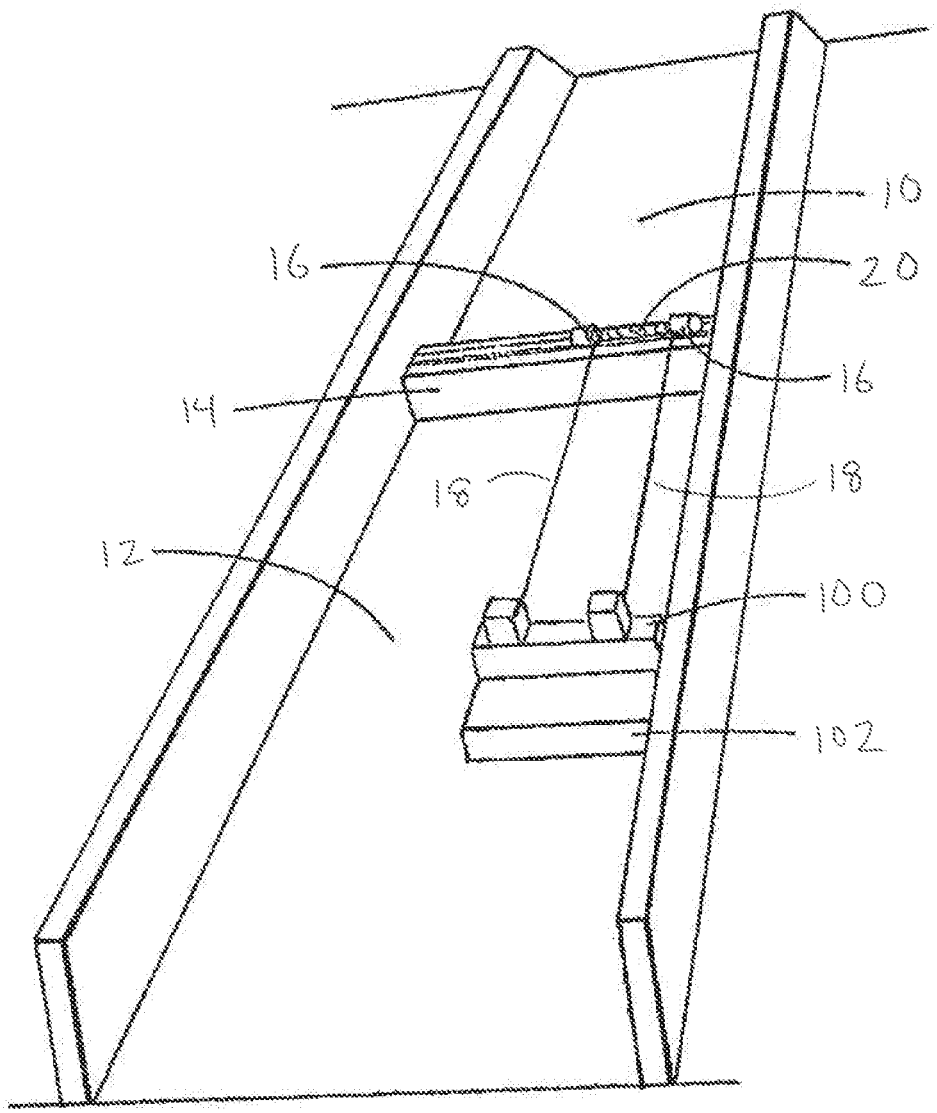
FIG. 1 is a perspective view of the system according to the preferred embodiment of the invention, mounted on the wall to be hydrodemolished, showing a conceptualized version of the hydrodemolition rig.
Figure 2:
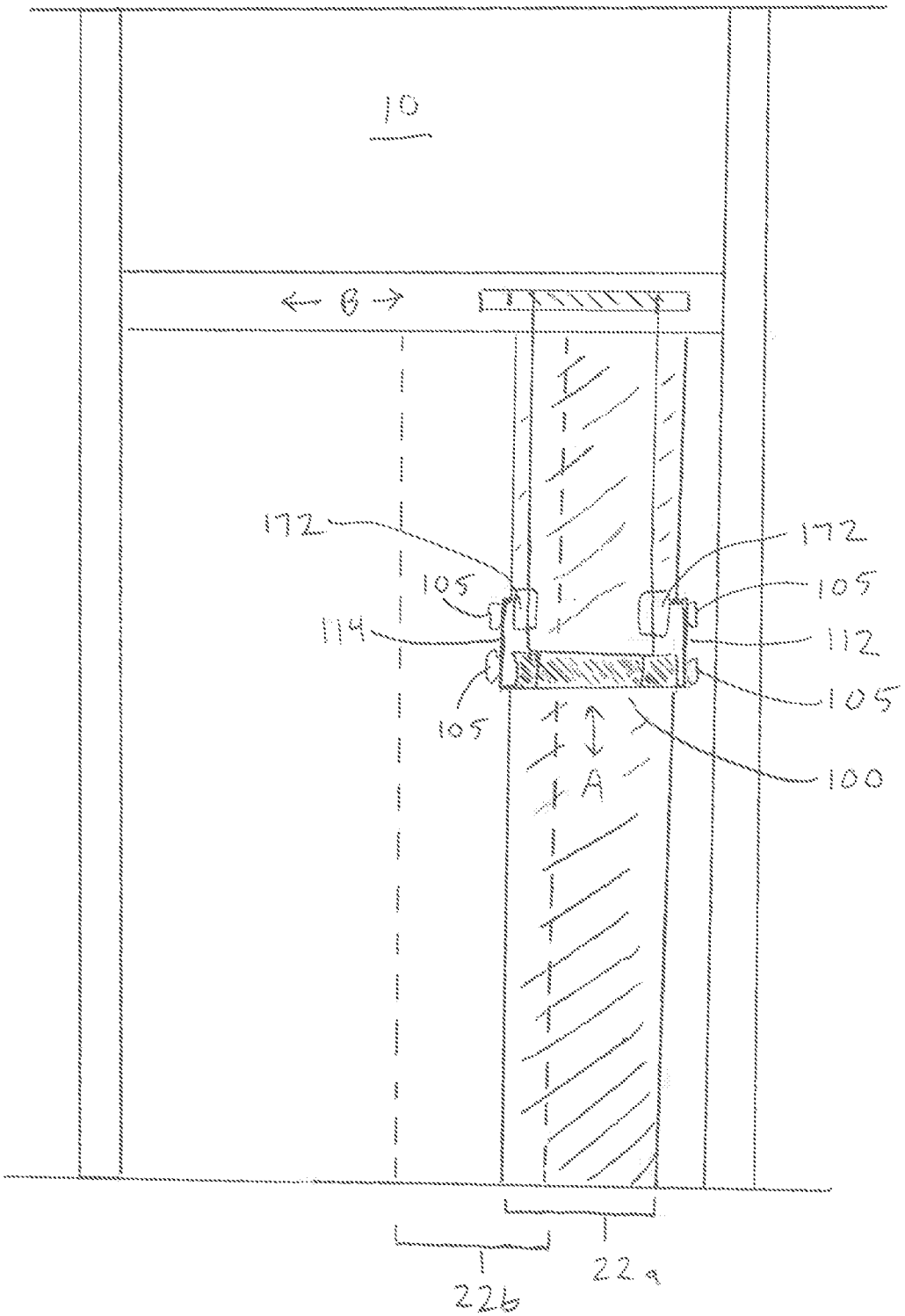
FIG. 2 is a top view of the system of FIG. 1.

Referring to FIGS. 1 and 2, a surface 10 to be hydrodemolished may comprise a wall 12 extending hundreds of feet in width and/or height. A suspension staging platform 14 may be provided to extend transversely along the width of the wall 12, above the region of the wall 12 that is to be hydrodemolished. A hydrodemolition rig 100 may be suspended from the staging platform 14 to overlie an area of the wall 12 by means of a cable winch system 16 that is mounted on the staging platform 14 and that is transversely movable along the staging platform 14 by a trolley 20. The rig 100 is suspended by cables 18.

According to this embodiment, the trolley 20 will preferably be initially located proximate to one end of the staging platform 14. Using the cable winch system 16, the rig 100 may be moved up and/or down along the incline direction of the wall 12 (along direction A in FIG. 2) below the staging platform 14. As the rig 100 travels along the wall 12, a portion of the wall 12 under the rig 100 is simultaneously hydrodemolished. In this manner, a vertical portion 22*a* of the wall 12 may be hydrodemolished as the rig 100 travels up and/or down the wall 12. The hydrodemolition removes the top layer of the surface of the wall to a certain depth, for example several inches.

After the rig 100 has completely hydrodemolishing the vertical section 22, the rig 100 may be moved transversely along the staging platform 14 (along direction B in FIG. 2) by the trolley 20 for further hydrodemolition of the wall 12. The rig 100 may again be moved up and/or down along the incline direction of the wall 12 below the staging platform in order to hydrodemolish another vertical portion 22*b* of the wall 12. Preferably, the transverse displacement of the rig 100 is such that vertical portions 22*a*, 22*b* overlap (as shown in FIG. 2), thereby forming a continuous hydrodemolished portion of the wall 12. As a result, the rig 100 will straddle a portion of the wall that has already been hydrodemolished and a portion that has not. After vertical portion 22*b* has been hydrodemolished, the rig 100 may be further moved transversely along the staging platform 14 to continue hydrodemolition of the wall 12. In this manner, a large continuous portion of the wall 12 may be hydrodemolished in a systematic approach.

Figure 3:
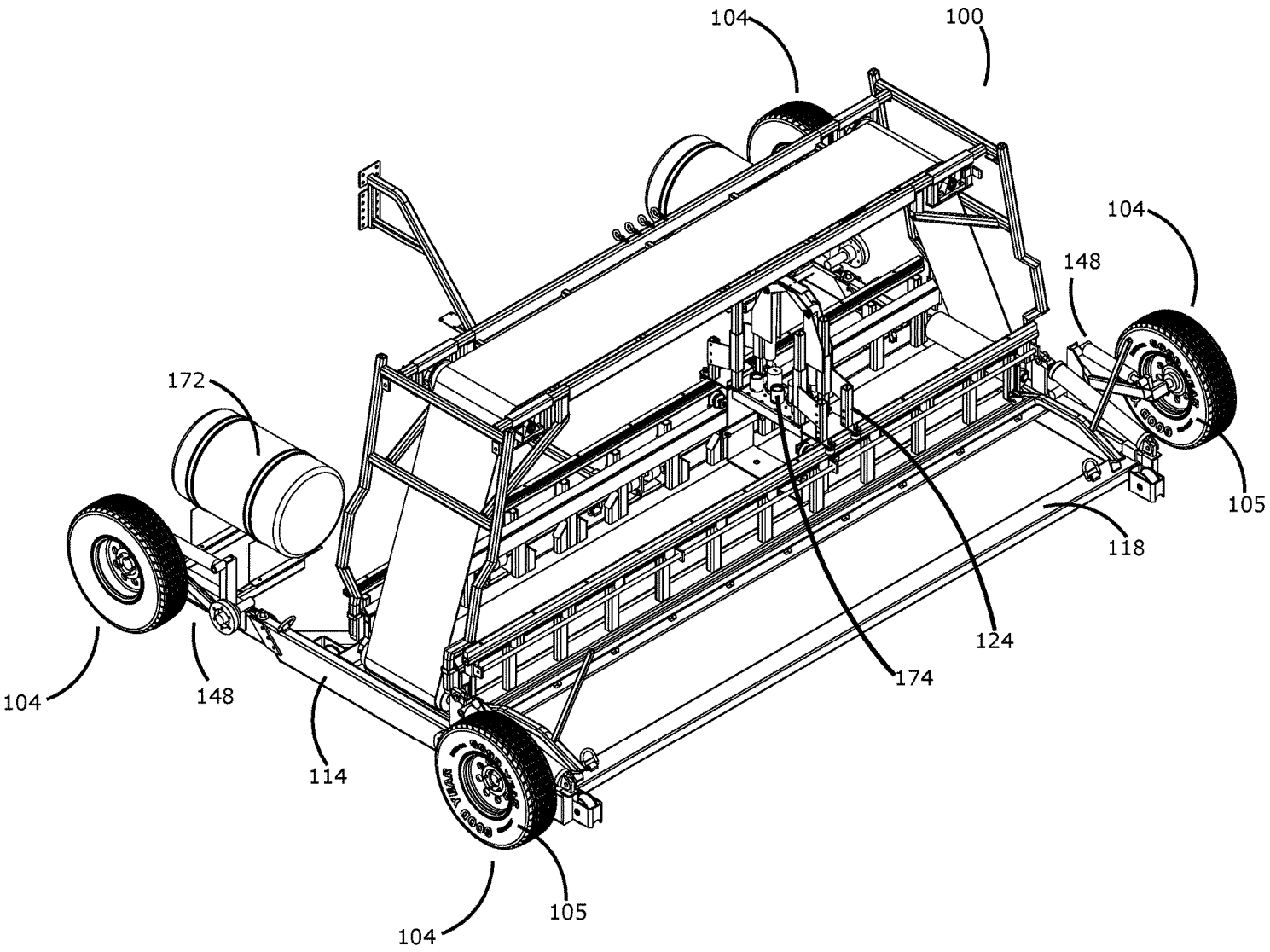
FIG. 3 is a front perspective view of the hydrodemolition rig of the preferred embodiment.
Figure 4:
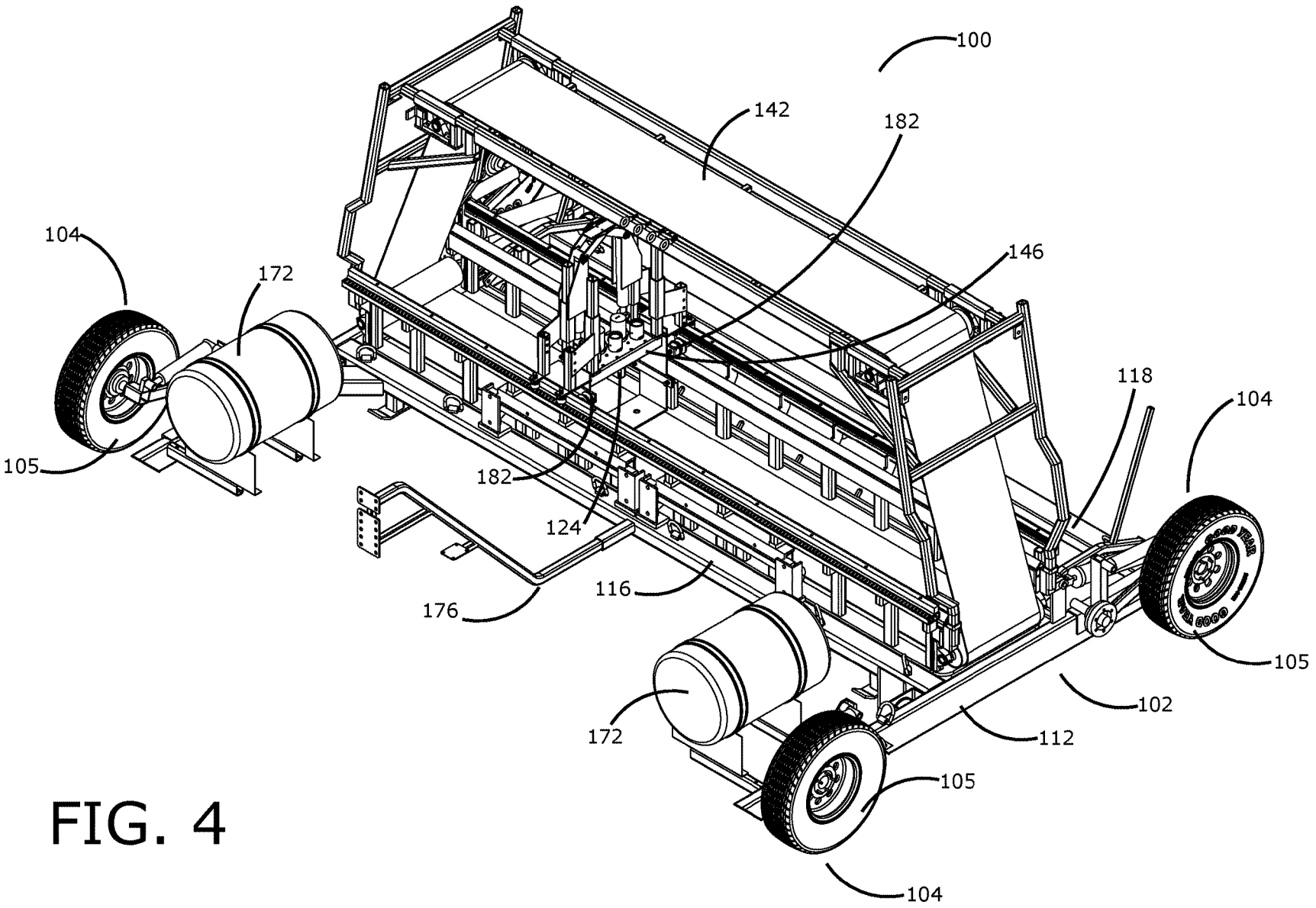
FIG. 4 is a rear perspective view of the hydrodemolition rig.
Figure 5:
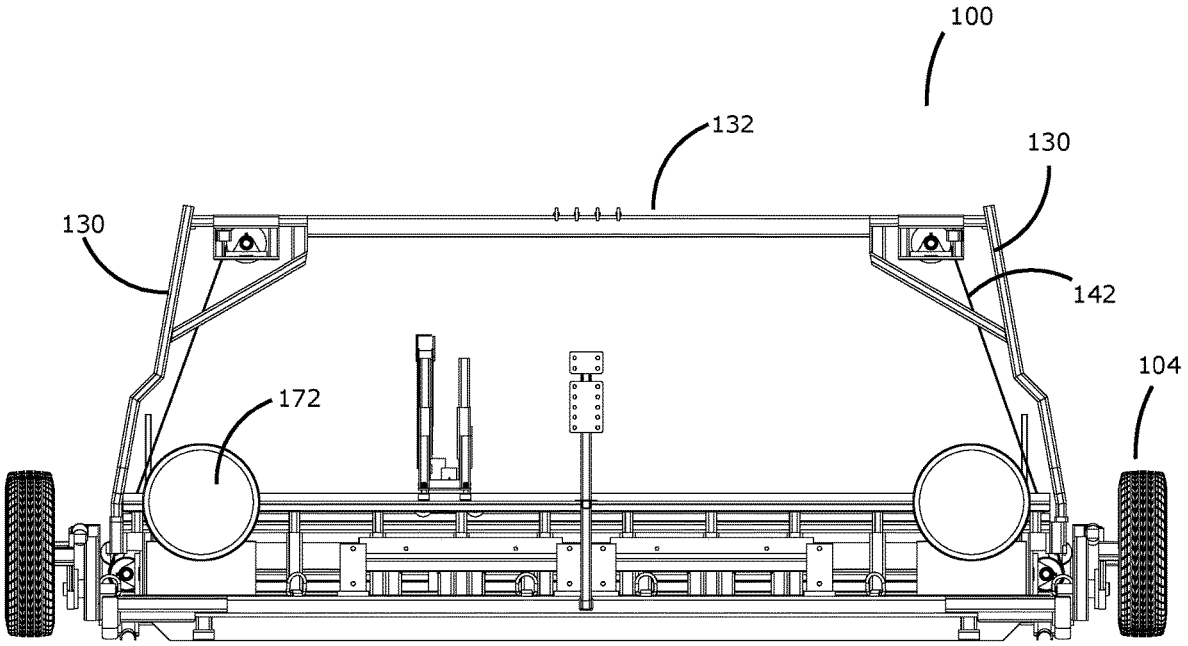
FIG. 5 is a rear view of the hydrodemolition rig.
Figure 6:
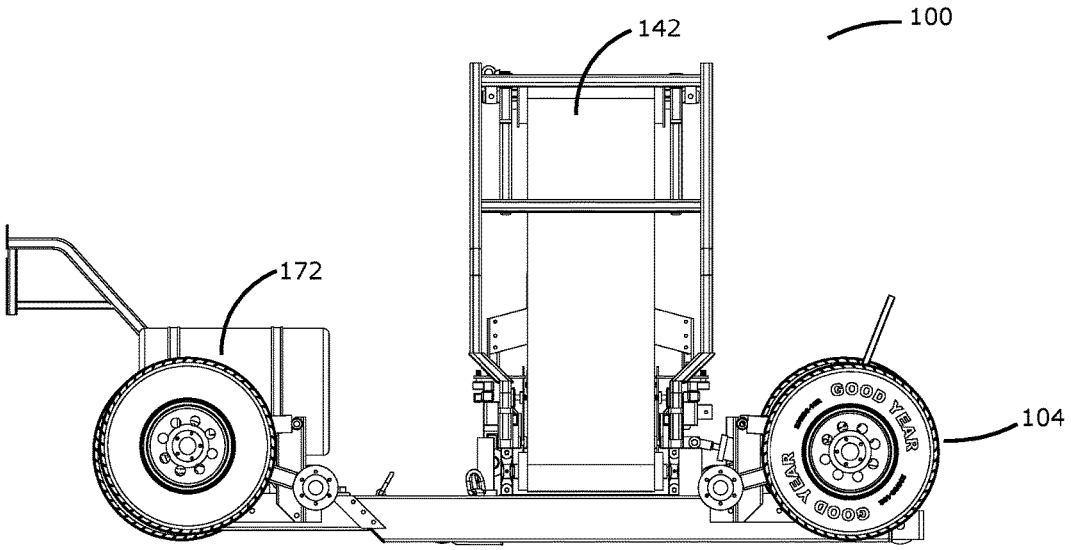
FIG. 6 is a side view of the hydrodemolition rig.

Referring to FIGS. 3 to 7, the rig 100 comprises a frame 102 supported by a plurality of wheel assemblies 104. Preferably, the wheel assemblies 104 are located on a periphery of the frame 102, such as at the corners of the frame 102, as shown in FIGS. 3 and 4. However, the wheel assemblies 104 may also be located at other positions along the frame 102. The wheel assemblies 104 allow the rig 100 to travel along the wall 12.

Figure 7:
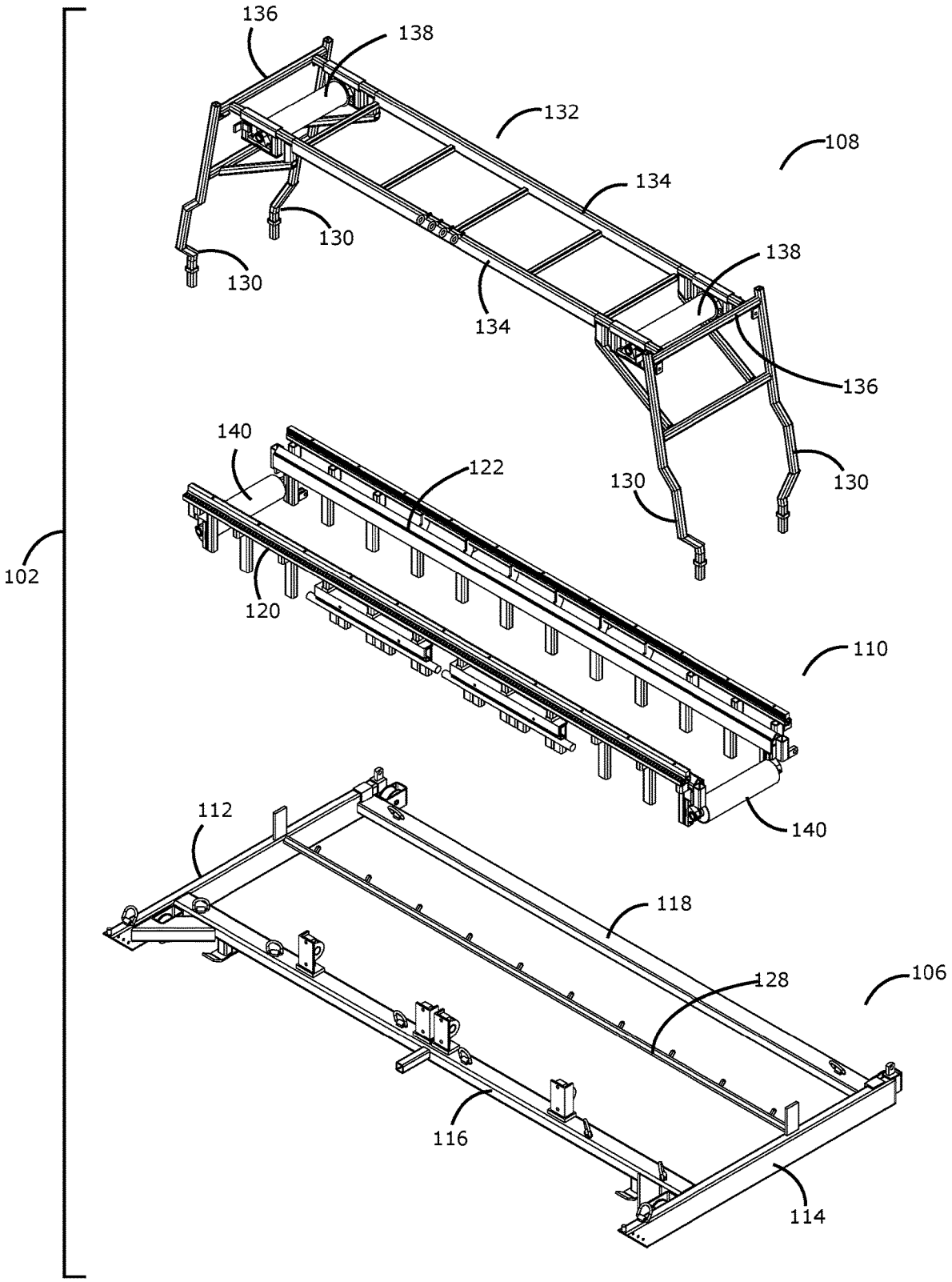
FIG. 7 is a partial exploded view of the hydrodemolition rig.

Referring to FIG. 7, the frame 102 comprises a lower frame 106, an upper frame 108, and a track assembly 110. The lower frame 106 comprises spaced side members 112, 114, with front and rear cross members 116, 118 extending between the side members 112, 114. The wheel assemblies 104 may be secured to the side members 112, 114 in a manner as discussed below.

The track assembly 110 comprises a pair of tracks 120, 122 that preferably extend for the width of the frame 102. The tracks 120, 122 are attached to the lower frame 106, with the track 120 preferably attached to the front cross member 116 and the track 122 preferably attached to a lower support member 128 on the lower frame 106. The tracks 120, 122 support a carriage 146 (see FIG. 2) comprising one or more nozzle assemblies 124 for discharging water towards the bottom of the rig 100 in order to hydrodemolish the underlying surface of the wall 12.

The upper frame 108 comprises legs 130 extending from either the track assembly 110 or the lower frame 106. The legs 130 support an upper platform 132 that is spaced above the track assembly 110. The upper platform 132 preferably comprises upper cross members 134 extending across a width of the rig 100 and upper support members 136 extending between the upper cross members 134.

The carriage 146 is able to move along the tracks 120, 122 through carriage wheels 182. In doing so, the nozzle assemblies 124 can be moved along a width of the rig 100 to hydrodemolish the surface of the wall 12 underlying the rig 100. Preferably, each of the nozzle assemblies 124 comprises one or more nozzles 174 for directing water from the rig 100 towards the wall 12 for hydrodemolition. All of the nozzle assemblies 124 are connected to a hose 176 that delivers water from a water source to the nozzle assemblies 124. Once the water reaches the nozzle assemblies 124, the water is released from the nozzle assemblies 124 through the nozzles 174.

The water from the nozzles 174 is released for hydrodemolition under pressure. As such, when the water impacts the surface of the wall 12, some of the water may splash back against the underside of the rig 100. In order to shield the interior of the rig 100 from any such splashes, a belt mechanism is preferably provided. Upper rollers 138 are provided on the upper platform 132, proximate to the ends of the upper cross members 134. Lower rollers 140 are similarly provided on the track assembly 110, proximate to the ends of the tracks 120, 122. The locations of the upper and lower rollers 138, 140 generally form the corners of a polygon, when viewed from the front of the rig 100. A belt 142 extends around the upper and lower rollers 138, 140, forming the perimeter of the polygon.

The carriage 146 is preferably attached to the belt 142, such that movement of the carriage 146 along the tracks 120, 122 will cause movement of the belt 142. The belt 142 is able to shield at least a portion of the underside of the rig 100 from any water splashing back from the surface of the wall 12.

Figure 8:
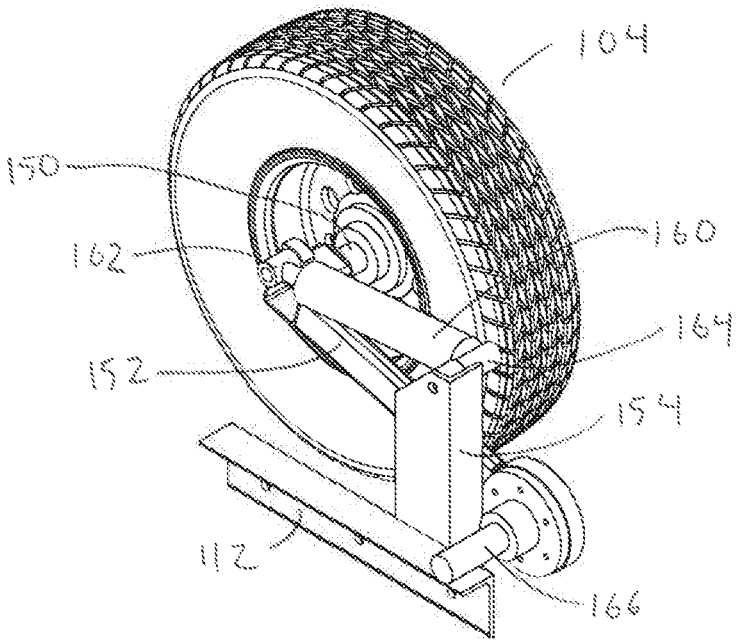
FIG. 8 is a partial view showing the wheel assembly of the hydrodemolition rig.
Figure 9:
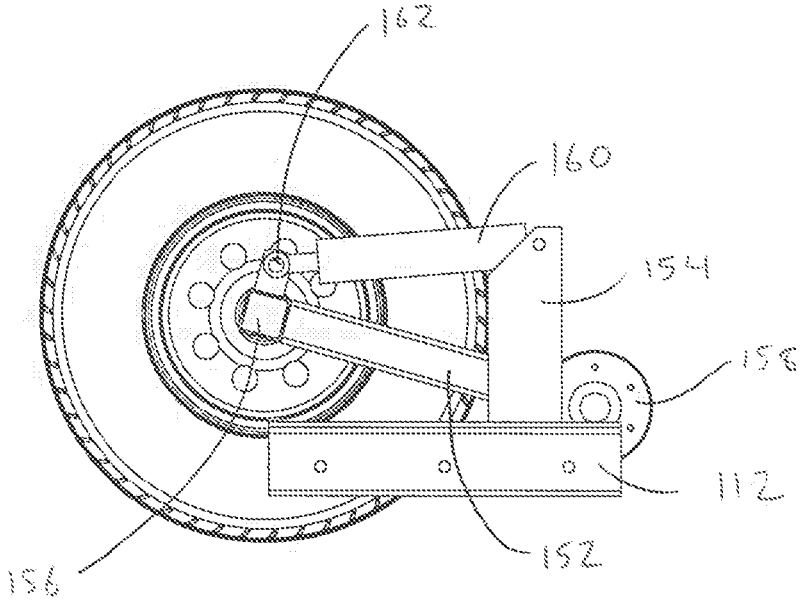
FIG. 9 is a side view of the wheel assembly of FIG. 8.

Referring again to FIGS. 3 to 6, one or more of the wheel assemblies 104 are connected to the lower frame 106 as described below. Each of the wheel assemblies 104 comprises a wheel 105 and a hydraulic assembly 148. Referring to FIGS. 8 and 9, the hydraulic assembly 148 comprises an axle 150 for attachment to the wheel 105, an arm 152, and a hydraulic cylinder 160. The axle 150 is rotationally attached to the arm 152, which is pivotably attached to the side members 112, 114 of the lower frame 106. The attachment of the arm 152 to the side members 112, 114 may be through a pin 166 that is rigidly connected to the side members 112, 114 but still allows for pivotable movement of the arm 152 with respect to the side members 112, 114. A bracket 154 is preferably provided on the lower frame 106 that is rigidly connected to the side members 112, 114. Preferably, the arm 152 comprises first and second arm ends 156, 158. The axle 150 may be connected to the arm 152 proximate to the first arm end 156, while the side members 112, 114 may be connected to the arm 152 proximate to the second arm end 158. The hydraulic cylinder 160, comprising first and second cylinder ends 162, 164, extends between the arm 152 and the bracket 154. Preferably, the arm 152 is pivotably attached to the hydraulic cylinder 160 proximate to the first cylinder end 162, while the hydraulic cylinder 160 is pivotably attached to the bracket 154 proximate to the second cylinder end 164.

Through this arrangement, any extension or retraction of the hydraulic cylinder 160 will cause the arm 152 to pivot with respect to the side members 112, 114, which will in turn result in a general overall upward or downward displacement of the axle 150 and the wheel 105. This results in a tilting of the rig 100 in relation to the underlying surface of the wall 12.

Referring again to FIGS. 1 and 2, when the rig 100 has completed hydrodemolition of the vertical portion 22*a*, the rig 100 is preferably moved transversely along the staging platform 14 to begin hydrodemolition of the vertical portion 22*b*. In the case where vertical portions 22*a*, 22*b* overlap, after the rig 100 has been moved transversely along the staging platform 14, all of the wheels 105 may not be level with one another because of the fact that the rig straddles portions of the wall of different depths (the hydrodemolished surface being deeper than the surface yet to be treated). For example, referring to FIGS. 10*a*, 10*b*, and 10*c*, if vertical portion 22*a* has been hydrodemolished (but vertical portion 22*b* has not yet been hydrodemolished), then after rig 100 has been moved transversely, the wheels 105 on side member 112 may sit within the (hydrodemolished) vertical portion 22*a*, while the wheels 105 on side member 114 may sit within the (non-hydrodemolished) vertical portion 22*b*. Therefore, the rig 100 will be tilted or inclined towards side member 112, resulting in the rig 100 no longer being generally parallel to the overall incline of the wall 12.

If the rig 100 is not generally parallel to the overall incline of the wall 12, then the water discharged from the nozzles 174 may not impact the surface of the wall 12 at an optimal angle. This can be mitigated by adjusting the tilt of the rig 100 so that its frame remains substantially parallel to the surface of the wall 12 that has not yet been hydrodemolished. This can be achieved by selectively actuating the hydraulic cylinders 160 of the hydraulic assemblies 148 for the appropriate wheels.

For example, in the arrangement shown in FIGS. 8 and 9, when the hydraulic cylinder 160 is extended, this will result in the arm 152 pivoting in a generally downward direction (with respect to the side members 112, 114). This downward movement of the arm 152 will have the effect of raising the portion of the side members 112, 114 generally proximate to the bracket 154 (which in turn will result in that region of the rig 100 being raised). Conversely, when the hydraulic cylinder 160 is retracted, the arm 152 will pivot in a generally upward direction. This upward movement of the arm 52 will have the effect of lowering the portion of the side members 112, 114 generally proximate to the bracket 154, relative to the rest of the frame 102.

Figure 10A:
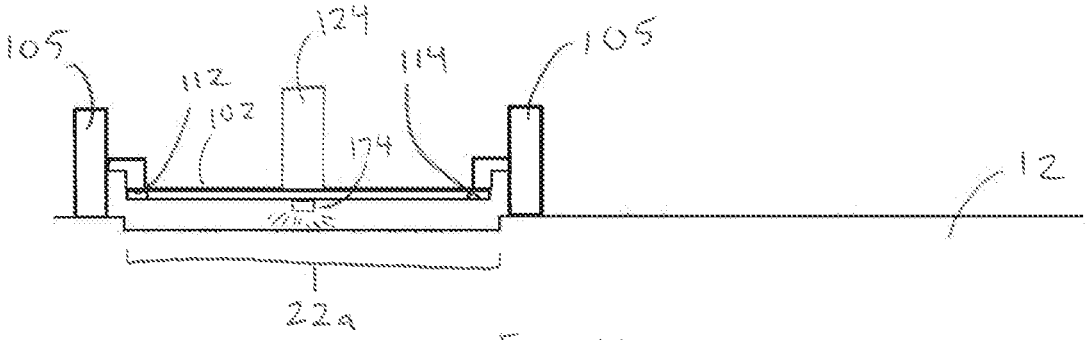
FIGS. 10*a*, 10*b*, and 10*c* show the levelling of the hydrodemolition rig.
Figure 10B:
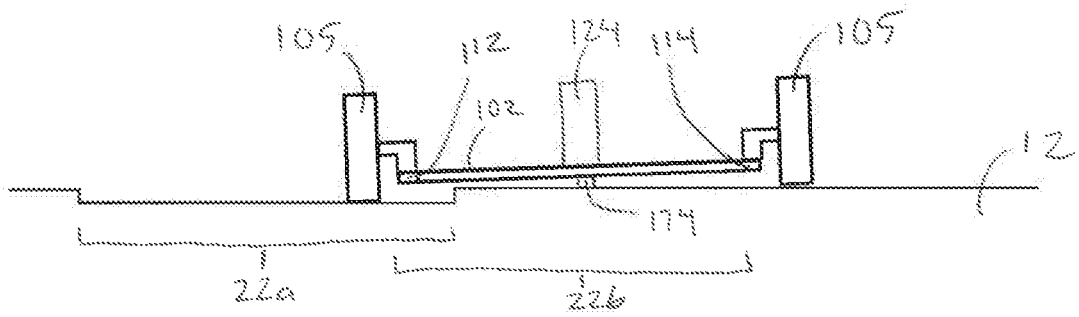

Referring to FIG. 10*a*, when the rig 100 has completed hydrodemolition of a portion of the wall 12 (e.g. vertical section 22*a*), that portion is generally depressed with respect to the rest of the wall 12. When the rig 100 is moved transversely to hydrodemolish another portion of the wall 12 (e.g. vertical section 22*b*), the rig 100 may no longer be sitting on a section of the wall 12 that is generally flat (e.g. the wheels 105 on side member 112 sit within a hydrodemolished section while the wheels 105 on side member 114 sit within a non-hydrodemolished section). The rig 100, including the frame 102, would generally not be parallel to the overall incline of the wall 12, as shown in FIG. 10*b*. However, by coordinating the movement of the various axles 150 and wheels 105, it is possible to adjust the posture of the rig 100 so that the incline of the rig 100 matches, or at least approaches, the overall incline of the wall 12.

Figure 10C:
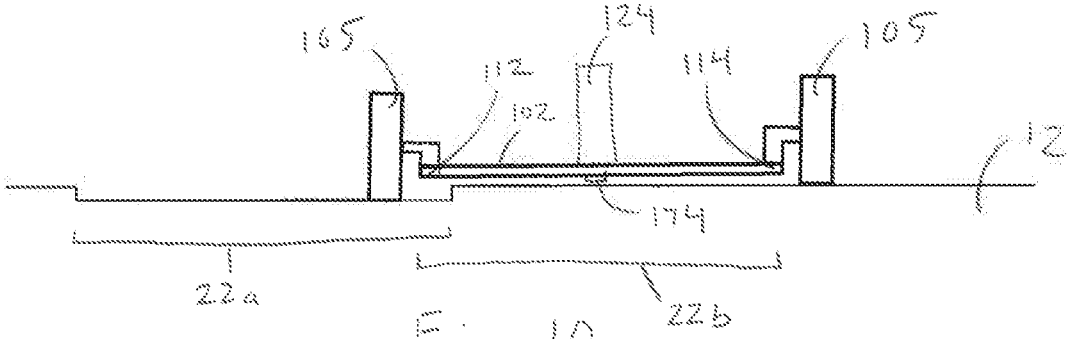

In the example above, this may require, for example, that the hydraulic cylinders 160 of the hydraulic assemblies 148 located on side member 112 be extended, thereby raising side member 112. Depending on the degree of tilt of the rig 100, this may also require that the hydraulic cylinders 160 of the hydraulic assemblies 148 located side member 114 be retracted, thereby lowering side member 114, as shown in FIG. 10*c*. By coordinating the extension of the hydraulic cylinders 160, it is possible to adjust the relative heights of side members 112, 114 and in doing so, adjust the tilt of the frame 102 and the rig 100.

The rig 100 may also comprise one or more ballast tanks 172 positioned at locations on the lower frame 106 in order to improve the overall stability of the rig 100 and to prevent the rig 100 from accidentally tipping over.

It will be appreciated that other constructional details may also be varied as required to achieve the objects of the invention.

The invention claimed is:

1. A hydrodemolition rig for an inclined surface comprising:

a frame;

a carriage configured to reciprocate within the frame and to carry one or more nozzles for delivering water to hydrodemolish the surface underlying the frame; and a plurality of wheel assemblies spaced from one another about the frame for supporting the frame on the surface, at least two of the wheel assemblies comprising:

a wheel; and a hydraulic assembly for selectively adjusting a spacing between the wheel and the frame, wherein each hydraulic assembly adjusts the spacing between the respective wheel and the frame independently of the other hydraulic assemblies.

2. The hydrodemolition rig of claim 1, wherein the wheel assemblies are located on a periphery of the frame.

3. The hydrodemolition rig of claim 1, wherein the frame comprises:

a lower frame;

an upper frame; and a track assembly between the lower frame and the upper frame.

4. The hydrodemolition rig of claim 3, wherein the lower frame comprises two spaced side members, wherein each of the hydraulic assemblies is connected to one of the side members.

5. The hydrodemolition rig of claim 4, wherein each of the hydraulic assemblies comprises:

an axle attached to the respective wheel of the respective wheel assembly;

an arm comprising first and second arm ends, wherein the arm is rotationally connected to the axle proximate to the first arm end, and wherein the arm is pivotably connected to the lower frame proximate to the second arm end; and a hydraulic cylinder comprising first and second cylinder ends, wherein the hydraulic cylinder is pivotably connected to the arm proximate to the first cylinder end, and wherein the hydraulic cylinder is pivotably connected to the lower frame proximate to the second cylinder end.

6. The hydrodemolition rig of claim 5, wherein the lower frame further comprises one or more brackets extending from the side members, and wherein each hydraulic cylinder is pivotably connected to the lower frame proximate to the respective second cylinder end at one of the brackets.

7. The hydrodemolition rig of claim 6, wherein each hydraulic cylinder is adapted to extend or retract independently of other hydraulic cylinders, thereby adjusting a spacing between the frame and the surface proximate to the location with respect to the respective wheel.

8. The hydrodemolition rig of claim 3, wherein the track assembly comprises at least two tracks connected to the lower frame and extending a width of the frame.

9. The hydrodemolition rig of claim 8 wherein the carriage is adapted to move along the tracks.

10. The hydrodemolition rig of claim 9, wherein the upper frame comprises a plurality of upper rollers and wherein the track assembly comprises a plurality of lower rollers.

11. The hydrodemolition rig of claim 10 further comprising a belt forming a closed loop extending around the upper rollers and the lower rollers.

12. The hydrodemolition rig of claim 11, wherein the belt is connected to the carriage.

13. The hydrodemolition rig of claim 3, wherein the upper frame comprises:

a plurality of legs extending from one of the lower frame or the track assembly; and an upper platform supported by the legs.

14. The hydrodemolition rig of claim 1 further comprising one or more ballast tanks attached to the frame.

15. A hydrodemolition rig for an inclined surface comprising:

one or more nozzle assemblies for delivering water for hydrodemolishing the inclined surface; and a plurality of wheel assemblies at various locations on a periphery of the hydrodemolition rig, wherein each of the wheel assemblies comprises:

a wheel for travel along the inclined surface; and a hydraulic assembly connected to the wheel, wherein the hydraulic assembly is adapted to adjust a height of the hydrodemolition rig proximate to the respective location with respect to the wheel;

wherein each of the hydraulic assemblies are configured to increase or decrease the height proximate to their respective locations independently of the other hydraulic assemblies.

16. The hydrodemolition rig of claim 15, wherein the one or more nozzle assemblies each comprise one or more nozzles.

17. A method of hydrodemolishing a surface of an inclined wall, the method comprising the steps of:

providing on said inclined wall a hydrodemolition rig comprising a frame, at least one nozzle assembly and a plurality of wheel assemblies, each of said wheel assemblies comprising:

a wheel; and a hydraulic assembly connected to the wheel and to a location on the frame, wherein the hydraulic assembly is adapted to adjust a height of the frame proximate to said location with respect to the wheel, directing said nozzle assembly to hydrodemolish a portion of said surface underlying said rig;

moving said rig transversely about said wall to hydrodemolish a further portion of said surface, wherein said rig straddles a hydrodemolished portion of said surface and an undemolished portion of said surface yet to be treated;

adjusting a tilt of the frame to orient the frame substantially parallel to said undemolished portion, by adjusting a height of said frame at at least one of said respective locations by means of said respective hydraulic assembly.

18. The method of claim 17, wherein the step of adjusting, for each of the hydraulic assemblies of the plurality of wheel assemblies, the heights at those respective locations comprises extending or retracting a hydraulic cylinder connected to the wheel and to the frame.

* * * * *